United States Patent [19]

Schröder

[11] 4,422,389

[45] Dec. 27, 1983

[54] SOLID-FUEL BURNER

[75] Inventor: Ulrich Schröder, Krefeld, Fed. Rep. of Germany

[73] Assignee: Deutsche Babcock Aktiengesellschaft, Oberhausen, Fed. Rep. of Germany

[21] Appl. No.: 392,354

[22] Filed: Jun. 25, 1982

[30] Foreign Application Priority Data

Jul. 1, 1981 [DE] Fed. Rep. of Germany ..... 3125901

[51] Int. Cl.[3] ..... F23M 7/08

[52] U.S. Cl. ..... 110/264; 110/347; 431/284

[58] Field of Search ..... 110/263, 264, 347; 431/284, 285

[56] References Cited

U.S. PATENT DOCUMENTS 4,147,116 4/1979 Graybill ..... 110/263
4,157,889 6/1979 Bohnel ..... 110/263
4,270,895 6/1981 Vatsky ..... 110/264 X
4,367,686 1/1983 Adrian ..... 110/264 X

FOREIGN PATENT DOCUMENTS 629909 4/1936 Fed. Rep. of Germany ..... 110/264

*Primary Examiner*—Edward G. Favors
*Attorney, Agent, or Firm*—Max Fogiel

[57] ABSTRACT

A burner for solid fuel in pulverulent form has a central conduit for primary combustion air, a fuel conduit surrounding the central conduit for admission of the pulverulent fuel, and one (or two concentric) secondary-air outer conduits. The annular space between the fuel conduit and the single (or the innermost) outer conduit is subdivided into two annular channels by an intermediate conduit. An inlet arrangement is provided for feeding combustion air into one of these channels, and another arrangement permits the selective feeding of either only combustion air, or of a mixture of such air with pulverulent fuel, into the other of the annular channels.

11 Claims, 1 Drawing Figure

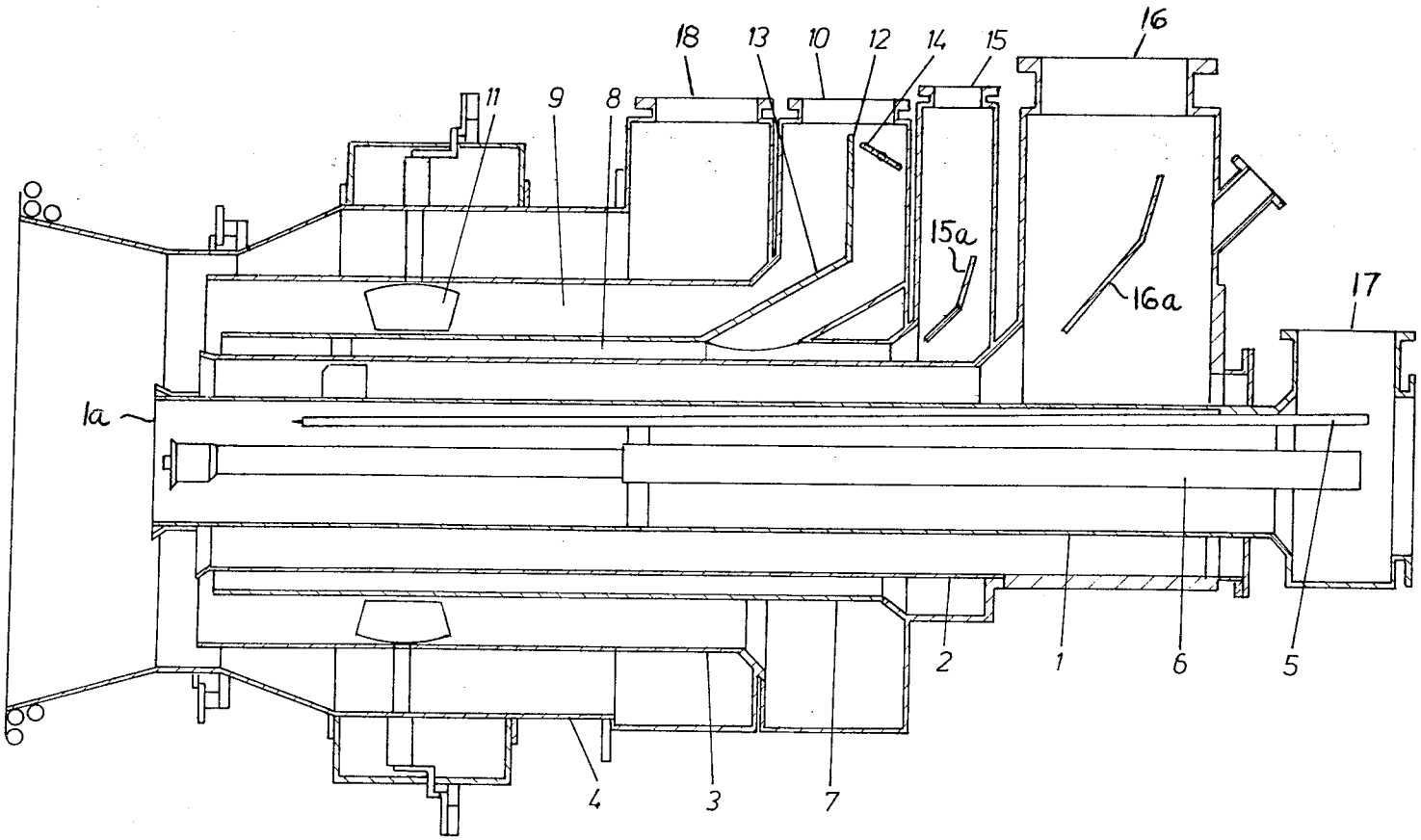
17
16
16a
15
15a
14
12
10
13
18
8
9
11
5
6
1
2
7
3
4
1a

SOLID-FUEL BURNER

BACKGROUND OF THE INVENTION

The present invention relates to a burner in general. More particularly, the invention relates to a solid-fuel burner.

Still more particularly, the invention relates to a burner for burning solid fuel in pulverulent form.

Burners of this general type are already known in the art. For example, a burner for a mixture of pulverulent fuel and combustion-supporting air is described in "VGB Kraftwerkstechnik 59", 1979, pages 98 and 99. That device may be provided with a tube for secondary combustion air, or even with still another combustion-air tube which surrounds the secondary-air tube. The central or primary-air tube of the burner houses the igniter lance which may be oil or gas-operated and which is fired up only during the burner start-up (in either the cold or warm start-up mode) or, if necessary, as a combustion-supporting aid during regular burner operation.

The above and other known burners of the type under discussion must necessarily operate along the just indicated lines, since in operation these burners—dependent upon the specific type of pulverulent fuel being used—permit a reduction of the burner capacity only down to at most 40–60% of their rated capacity. Even if an installation has several such burners and some of them are completely shut down, the heating capacity of the installation can generally at best be reduced only to 25–30% of the rated capacity. A reduction of the momentary heat output below this point—desirable as it may be for any of various reasons—is not feasible, for reasons of stability and to assure the necessary uniform combustion-chamber load. What this means, of course, is that the oil or gas-fired combustion lance cannot be shut down at will, so that—even tough the primary fuel is a pulverulent solid fuel—such installations require a substantial amount of oil or gas just to keep the combustion going.

It need not be specially emphasized that any avoidable use of gas or oil is wasteful, both in terms of the overall energy shortage and in terms of cost effectiveness. This is, of course, especially true in a system which is inherently based on the use of pulverulent solid fuel, i.e. where the use of gas or oil is only incidental and the waste occurs because burner (or system) operation cannot be controlled at will. To be able to effect such control in a pulverulent-fuel system, in particular a coal-dust combustion system, the system would have to be capable of permitting a constant increase in total heat output from about 5% after initial ignition, up to about 30–35% of the full rate load, of course taking into account the required uniformity of combustion-chamber loading. After the 30–35% output is reached the burner (or system) could then be switched over to operate at the installed heat capacity.

Attempts have been made in the prior art to arrive at this goal in a round-about way. Thus, German Pat. No. 923,213 suggests the installation of auxiliary burners with small rated capacity in the system, to be used for the ignition and start-up phases only. However, although this solution is theoretically feasible, it requires additional space which is quite simply often not available in the combustion chamber.

Another proposal, made in German Allowed Application No. 2,933,060, is to install within the primary-air tube a small-dimension and small-capacity coal-dust burner, rather than to use a burner which is fired by oil or gas. This would, of course, eliminate the use of oil or gas; however, the dimensions of the primary-air tube cannot be increased at will and such an auxiliary coal-dust burner must itself have a certain size (to achieve the necessary start-up heat rate of about 20–35% of the main-burner rated capacity) which in many instances makes it impossible to accommodate in the primary-air tube.

SUMMARY OF THE INVENTION

Accordingly, it is an object of the present invention to overcome the disadvantages of the prior art.

More particularly, it is an object of the invention to provide an improved pulverulent-fuel burner which is not possessed of those disadvantages.

Still more specifically, it is an object of the present invention to provide such an improved pulverulent-fuel burner which is capable of operating over a much wider heat-output range than those known from the prior art, but using exclusively pulverulent fuel over the entire range.

Pursuant to these objects, and still others which will become apparent hereafter, one feature of the invention resides in a burner for the combustion of solid fuel in pulverulent form, the burner being of the type having a first conduit for primary combustion-supporting fluid and being spacedly surrounded by a second conduit for the pulverulent fuel, which second conduit is in turn spacedly surrounded by a third conduit for secondary combustion-supporting fluid.

In a burner of this type the invention may comprise, briefly stated, an intermediate conduit between the second and third aforementioned conduits, so as to subdivide the space between them into two annular channels which extend lengthwise of the axes of the first-mentioned three conduits and communicate with the burner outlet. In addition, first means are provided for admitting combustion-supporting fluid into one of these annular channels, and second means are also provided for selectively admitting into the other channel either only combustion-supporting fluid or a mixture of such fluid with solid fuel in pulverulent form.

At full rated load the space between the first and second conduits in the burner according to the invention receives a mixture of combustion-supporting fluid (i.e. normally air, as the fluid will hereafter be called for convenience) and pulverulent solid fuel, whereas the interior of the first conduit and the interior of either one or both of the annular channels is fed with combustion air. If, on the other hand, the burner is to be operated at partial (i.e. below full rated) load, no solid fuel is admitted to the spaced between the first and second conduits. Instead, a mixture of pulverulent solid fuel and combustion air is admitted through one of the annular channels and primary combustion air is admitted exclusively through the other of these channels. The other conduit passages of the burner receive only small flows of blocking and cooling air, i.e. not intended and not sufficient for combustion-supporting purposes.

The dimensioning of the cross-sections of the first, second and third conduits is governed in this burner by the requirements for normal (i.e. up to full rated load) operation of the burner. The division of the space between the first and second conduits into the aforementioned two annular channels, on the other hand, is based upon and takes into account the volume flow and the flow speed of the primary secondary combustion air required for the burner start-up operation. The division into these two annular channels is believed to make it possible to operate the burner in normal operating mode at 30–40% of the full rated burner load, using the two annular channels alone. This means that if the burner is instead operated at only partial load, again using the two annular channels alone and operating at 50% of their nominal capacity, the burner can be operated at a partial load as low as 15–20% of the full rated load.

Particularly low partial loads are attainable with the burner according to the invention if the secondary combustion air is divided into two partial streams or flows. The cross-section of the inner secondary combustion-air conduit can then be made relatively small,. During operation in the partial-load range, the supply of air to the outer secondary-air conduit is stopped; the annular channel which now carries the combustion air within the inner secondary-air conduit, is so related to the other annular channel (empirical determination will suffice for this) that the air supply is adequate even though the quantity of pulverulent fuel carried in the other channel is small. Thus, the burner according to the present invention can be successfully operated at a much lower partial load—using pulverulent solid fuel exclusively—than those known from the prior art and, therefore, has an operating range and versatility not attainable in the prior art.

The invention will hereafter be described with reference to an exemplary embodiment, as illustrated in the appended drawing. However, it is to be understood that the drawing is intended only for purposes of explanation and that the invention it is sought to protect is authoritatively defined in the appended claims.

BRIEF DESCRIPTION OF THE DRAWING

The single FIGURE is a substantially diagrammatic longitudinal section through a burner according to the present invention.

DESCRIPTION OF PREFERRED EMBODIMENTS

Before entering into a description of the FIGURE, it should be noted that the burner according to the invention is normally intended for horizontal or near-horizontal installation. However, it can be installed in any other desired orientation also, except that it will then be necessary—as already known from the prior art—to appropriately change the inflow rate of the pulverulent fuel.

Proceeding now to a description of the FIGURE, it will be seen that in the illustrated embodiment the burner is of circular cross-section and has a central or first conduit 1 which surrounds and defines the longitudinal axis of the burner, and which serves to carry the primary combustion air. Conduit 1 has an outlet 1*a*, as shown, at the flame end of the burner. A second conduit 2 surrounds conduit 1 and carries a stream composed of air and pulverulent solid fuel, such as powdered coal. The conduit 2 is in turn surrounded by a third conduit, namely an inner secondary-air conduit 3 which (advantageously) may or may not be surrounded by an outer secondary-air conduit 4. The conduits 1, 3 and 4 receive air from a not illustrated (but known per se) air supply, each receiving a partial quantity of the total combined air stream needed to support the combustion of the solid fuel which is being admitted via the conduit 2.

An igniter—known per se from the art—is arranged within the confines of the conduit 1 and, in the illustrated embodiment, is composed of an ignition lance 5 and an oil or gas-fired ignition burner 6.

In accordance with the invention an intermediate conduit 7 is arranged in the annular space defined between the conduits 2 and 3; it serves to subdivide this annular space into two annular channels 8 and 9 which extend lengthwise of the burner axis surrounded by the conduit 1. An inlet 10 for secondary combustion air communicates with the interior of conduit 3 or, rather, with the annular channel 9 which is created by the presence of the intermediate conduit 7. Mounted in the channel 9—and adjustable from ouside the burner in a manner known per se from the prior art—are spin baffles which impart a spin (circumferentially of the burner axis) to the airstream flowing in the channel 9. Similar baffles may, incidentally, also be installed in the conduit 4 if desired or considered advisable.

The other of the annular channels, i.e. here the channel 8, communicates with a pipe 12 which is installed in the inlet 10 and which receives air from the same source as the inlet 10. The inner end portion 13 of the pipe 12, i.e. the end portion which opens into the channel 8, is so inclined towards the outlet 1*a* that its longitudinal axis includes an acute angle with the longitudinal axis of the burner (and hence of the channel 8). It should be noted that it is not necessary to restrict the construction to a single inner end portion 13; pipe 12 could communicate with a plurality of such end portions 13 which are all inclined in the illustrated manner and are uniformly distributed about the circumference of the channel 8. Since air may or may not be supplied via the channel 8 at various times, a blocking or throttle valve 14 is installed in the pipe 12, so as to permit the inflow of air from the inlet 10 into the pipe 12 and thence to the channel 8, to be fully or partially blocked or to be completely free of such blockage, as the case may be.

When air is admitted into channel 8 via the pipe 12 it may, in addition to its axial flow-speed component, also be given a tangential flow-speed component, e.g. a spin motion. In the illustrated embodiment this tangential component is enforced upon the airstream by the fact that the longitudinal axis of the end portion 13 (or the axes of the end portions 13, if there are several) is arranged skew to the longitudinal burner axis, which is to say that it does not intersect the longitudinal burner axis. Other possibilities exist also, of course. For example, the inlet 10 and the pipe 12 could be connected to different air sources. Further, known-per-se spin-imparting instrumentalities may be installed in the pipe 12 and/or in the end portion(s) 13 thereof.

In addition to being connected with the air supply pipe 12 the channel 8 also communicates with a supply pipe 15 for a mixture of combustion air and pulverulent solid fuel. The supply of this mixture to the pipe 15 is entirely independent of the supply of similar combustible mixture to the conduit 2. Note that when such mixture is in fact supplied to the channel 8, the forward and downward inclination of the end portion 13 of pipe 12 prevents the entry of pulverulent fuel into the pipe 12.

When the above-described burner according to the invention is to be operated at full rated load, a mixture of combustion air and pulverulent solid fuel is admitted to the conduit 2 via an inlet 16. Conduits 1, 3 and 4 receive combustion-supporting air via inlets 10, 17 and 18, respectively. As far as conduit 3 is concerned, the admitted air enters the channels 8 and 9 and flows along therein to the flame end of the burner. If desired, the valve 14 may be closed so that air is excluded from the channel 8 and flows only through the channel 9.

If the burner is to be operated at partial load, using only the channels 8 and 9, the supply of air/fuel mixture via the conduit 2 is terminated. Instead, air/fuel mixture is now admitted to the channel 8 via the pipe 15, with the blocking valve 14 in the pipe 12 being set for its closed (blocking) position. In this operating mode, combustion air is admitted only via the channel 9. Small quantities of air—not sufficient for combustion-supporting purposes—are admitted into the conduits 1, 2 and 4, but only to the extent necessary to cool these conduits and to block any backflow of fuel and deposition of ashes therein.

It is evident from the drawing and the above description that for partial-load operation only portions of the burner cross-sections are used, just as it is equally clear that this does not involve any increase in the overall exterior burner dimensions. Thus, the burner according to the present invention can be installed anywhere a similar burner not utilizing the invention can find sufficient space. Yet, contrary to the prior-art burners, the burner according to the invention is capable of stable operation at a load—e.g. during the start-up phase of a boiler fired with the burner—which is much lower than anything attainable in the prior art. Putting this another way, it may be said that the burner according to the invention is capable of operating—on solid pulverulent fuel alone—over a much wider load range than the prior-art burners, so that the objects of the invention are fully met.

I claim:

1. In a burner for the combustion of solid fuel in pulverulent form and having a first conduit for primary combustion-supporting fluid, the first conduit being spacedly surrounded by a second conduit for the pulverulent solid fuel, and a third conduit for secondary combustion-supporting fluid spacedly surrounding the second conduit, a combination comprising an intermediate conduit between said second and third conduits and subdividing the space therebetween into two annular channels;

first means for admitting combustion-supporting fluid into one of said channels;

second means for selectively admitting combustion-supporting fluid, or a mixture of such fluid with pulverulent solid fuel, into the other of said channels;

a main inlet pipe communicating with said third conduit for admitting combustion-supporting fluid thereto; an auxiliary inlet pipe communicating with said other channel; and means for selectively blocking and unblocking the flow of combustion-supporting fluid through said auxiliary pipe into said other channel.

2. A combination as defined in claim 1; and further comprising a fourth conduit for secondary combustion-supporting fluid, said fourth conduit surrounding said third conduit.

3. A combination as defined in claim 1, wherein said one channel surrounds said other channel.

4. A combination as defined in claim 1, the last-mentioned means being mounted in said auxiliary inlet pipe.

5. A combination as defined in claim 1; and further comprising two discrete sources of combustion-supporting fluid and connected with said main and auxiliary pipes, respectively.

6. A combination as defined in claim 1, said auxiliary pipe including a generally radial outer end portion and an inner end portion connecting said outer end portion with said other channel.

7. A combination as defined in claim 1, said auxiliary pipe including a generally radial outer end portion, and a plurality of inner end portions connecting said outer end portion with said other channel and being distributed circumferentially of the latter.

8. A combination as defined in claim 6, each inner end portion having a central longitudinal axis which includes an acute angle with a longitudinal axis of said channel.

9. A combination as defined in claim 6, each inner end portion having a central longitudinal axis which includes with a longitudinal axis of said other channel an acute angle, said central axis extending skew with reference to said longitudinal axis.

10. A combination as defined in claim 1, said auxiliary pipe including a generally radial outer end portion, and at least one inner end portion connecting said outer end portion with said other channel; and spin-imparting means in at least one of said main pipe and inner end portion for imparting to fluid flowing therethrough a spin circumferentially of said longitudinal axis.

11. A method of operating a burner for the combustion of solid fuel in pulverulent form, comprising the steps of: providing a first conduit for primary combustion-supporting fluid and surrounding said first conduit spacedly by a second conduit for pulverulent solid fuel; surrounding said second conduit spacedly with a third conduit for secondary combustion-supporting fluid; inserting an intermediate conduit between said second and third conduits and subdividing the space therebetween into two annular channels; operating said burner at full-rated load by the steps of: feeding combustion-supporting fluid into said first and third conduits and into one of said channels while feeding a mixture of such fluid and of pulverulent solid fuel into said second conduit; and operating said burner at partial-rated-load by the steps of: feeding a mixture of combustion-supporting fluid and of pulverulent solid fuel into said other channel while blocking the feed of such mixture to said second conduit and feeding to said first and third conduits and to said one channel quantities of air which are just sufficient to effect blocking and cooling thereof.

* * * * *